United States Patent [19]

Fukuroi

[11] 4,437,210

[45] Mar. 20, 1984

[54] BRIDGE TOP STOP FOR SLIDE FASTENERS

[75] Inventor: Takeo Fukuroi, Uozu, Japan

[73] Assignee: Yoshida Kogyo K.K., Tokyo, Japan

[21] Appl. No.: 262,195

[22] Filed: May 11, 1981

[30] Foreign Application Priority Data

May 30, 1980 [JP] Japan ..... 55-75372[U]

[51] Int. Cl.[3] ..... A44B 19/36

[52] U.S. Cl. ..... 24/435; 24/703

[58] Field of Search ..... 24/205.11 R, 205.14 R, 24/205.14 A, 205.11 L, 205.11 F, 168, 169, 205

[56] References Cited

U.S. PATENT DOCUMENTS

| | | | |
|---|---|---|---|
| 114,580 | 5/1871 | Martin | 24/168 |
| D. 141,837 | 3/1945 | Brozek | 24/205.11 R |
| 2,063,879 | 11/1934 | Norton | 24/205.11 R |
| 2,191,280 | 2/1940 | Kiessling | 24/205.11 R |
| 2,281,000 | 4/1942 | Carlile | 24/205 |
| 4,109,349 | 8/1978 | Tanaka | 24/205.11 R |

FOREIGN PATENT DOCUMENTS

| | | | |
|---|---|---|---|
| 2447705 | 10/1974 | Fed. Rep. of Germany | 24/205.11 R |
| 2459963 | 12/1974 | Fed. Rep. of Germany | 24/205.11 R |
| 1439904 | 6/1976 | United Kingdom | 24/205.11 R |

*Primary Examiner*—Gene Mancene
*Assistant Examiner*—Kris R. Schulze
*Attorney, Agent, or Firm*—Bucknam and Archer

[57] ABSTRACT

A bridge top stop for slide fasteners comprising: a body including a sidewall inwardly curved to define a substantially inverted U-shaped opening and a pair of plates connected at one edge by the sidewall, each of the plates including a pair of laterally spaced first and second wing portions extending away from said opening and forming in confronting pair together with the sidewall a pair of grooves for receiving therein the reinforced edges, respectively; a bulged rib projecting from the sidewall into the opening and extending longitudinally along the sidewall; and ridges disposed on the respective free ends of the wing portions and extending longitudinally along the grooves respectively for clamping engagement with the stringer tapes.

2 Claims, 6 Drawing Figures

BRIDGE TOP STOP FOR SLIDE FASTENERS

BACKGROUND OF THE INVENTION

1. Field of the Invention

This invention relates to slide fasteners and more particularly to a bridge top stop for slide fasteners.

2. Prior Art

As is well known in the art, the top stop of the type described is secured in place astride the top ends of a pair of oppositely disposed stringer tapes each carrying on and along its one longitudinal edge a row of interlocking fastener elements, to thereby restrict or terminate the movement of a slider when closing the fastener. Slide fasteners using bridge top stops are suitable especially for use on bags or pouches because the bridge top stop can prevent the top ends of the stringer tapes from being spread apart when the fastener is closed. One prevalent form of such bridge top stop is disclosed in U.S. Pat. No. 2,281,000, patented Apr. 28, 1942 and including a pair of generally tubular tape holding members connected at their upper ends by a relatively narrow transverse bridge portion, the tape holding members being adapted to be secured to the reinforced edges of stringer tapes, respectively. The known bridge top stop, however, is disadvantageous in that when clamped to the reinforced tape edges, the tape holding members tend to spread apart or move angularly about the bridge portion away from each other due to stresses applied, with the results that the top ends of the stringer tapes are crossed, rendering the slide fastener to become unsightly. Furthermore, the tape holding members thus spread apart cannot hold the reinforced tape edges positively, resulting in the risk of allowing the latter to get withdrawn from the former. The foregoing drawbacks have also occurred when a slider abuts against the bridge top stop to close the slide fastener or when the stringer tapes are subjected to severe lateral pull exerted during the use of the slide fastener.

SUMMARY OF THE INVENTION

A bridge top stop comprises a body including a pair of plates connected at one edge by a sidewall inwardly curved to define a substantially inverted U-shaped opening. Each of the plates includes a pair of laterally spaced first and second wing portions extending away from the opening, the first wing portions and the second wing portions in confronting pair forming jointly with the sidewall a pair of grooves for receiving therein the reinforced tape edges of a slide fastener, respectively. A bulged rib projects from the sidewall into the opening and extends longitudinally along the sidewall. Each confronting pair of the wing portions has ridges disposed on the respective free ends thereof and extending longitudinally along one of the grooves for clamping engagement with one of the stringer tape of the slide fastener.

It is an object of the invention to provide a bridge top stop for slide fasteners which maintains a pair of stringer tapes in a predetermined relation even when the stringer tapes are subjected to severe lateral pull.

Another object of the present invention is to provide a bridge top stop for slide fasteners which, when clamped to the reinforced tape edges of a slide fastener, is secured reliably and stably thereto against an undesirable movement of the tape holding portions and withdrawal of the reinforced tape edges therefrom.

Still another object of the invention is to provide a bridge top stop which can be clamped firmly to the reinforced tape edges with the clamping forces uniformly distributed thereover.

Many other advantages, features and additional objects of the present invention will become manifest to those versed in the art upon making reference to the detailed description and the accompanying drawings in which preferred structural embodiments incorporating the principles of the present invention are shown by way of illustrative example.

DETAILED DESCRIPTION

Figure 1:
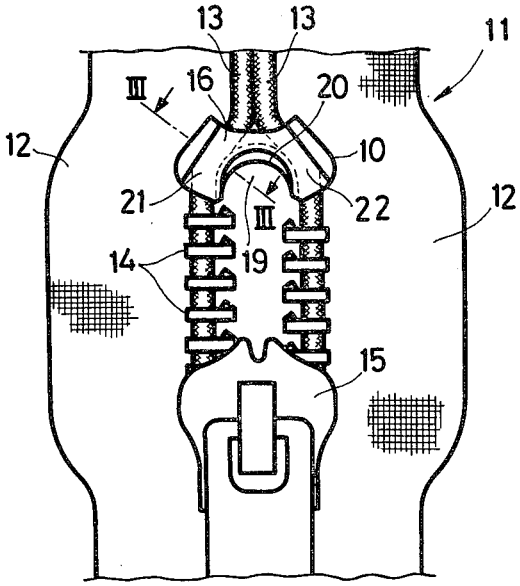
FIG. 1 is a fragmental plan view of a slide fastener provided with a bridge top stop, according to the present invention.

As shown in FIG. 1, a bridge top stop 10 according to the present invention is applied to a slide fastener 11 of the type which comprises a pair of opposed stringer tapes 12 each having a reinforced edge 13 which carries a row of discrete cooperating interlocking fastener elements 14 clamped or otherwise secured thereto in known manner. The slide fastener 11 further comprises a slider 15 mounted thereon for reciprocal movement along the reinforced edges 13 to take the fastener elements 14 into and out of coupling engagement with one another to thereby close and open the slide fastener 11. The lower ends of the reinforced edges 13 of the stringer tapes 12 are connected in conventional manner by a suitable bottom end fitting or bottom stop (not shown).

Figure 2:
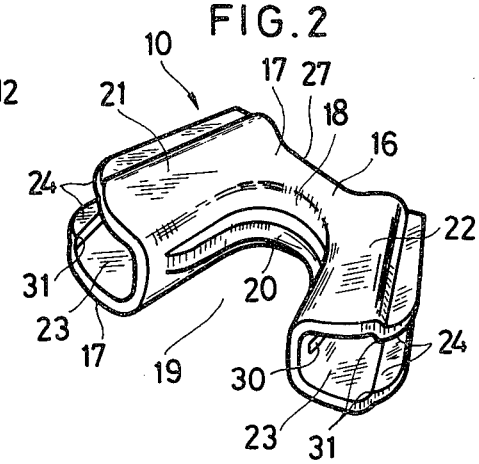
FIG. 2 is an enlarged perspective view of the bridge top stop shown in FIG. 1.

As best shown in FIG. 2, the bridge top stop 10 is formed by pressing a sheet of metal into a generally inverted U-shaped contour. The bridge top stop 10 comprises a body 16 adapted to be clamped or otherwise secured to the reinforced edges 13 astride the stringer tapes 12. The body 16 includes a pair of upper and lower plates 17 connected at one edge by a sidewall 18 inwardly curved to define a substantially inverted U-shaped opening 19 for receiving therein the front end portion of the slider 15 when closing the slide fastener 11.

The sidewall 18 is formed on one or outer surface with a bulged rib 20 formed by pressing to project therefrom into the inverted U-shaped opening 19 and extending longitudinally along the sidewall 18 substantially over the full length of the same. There is a recess 30 in another or inner surface of the sidewall 18 produced as the result of formation of the bulged rib 20, the bulged rib 20 defining thereinside the recess 30. Preferably, the bulged rib 20 projects progressively into the opening in a direction from ends of the sidewall 18 to the mid portion of the same to trace a crescent as best illustrated in FIG. 1. Accordingly, the recess 30 progressively increased in its depth in a direction from ends to the mid portion of the sidewall 18.

Figure 6:
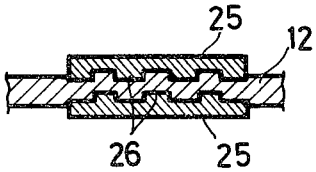
FIG. 6 is a cross-sectional view showing a stringer tape to which is clamped the bridge top stop shown in FIG. 5.

Each of the plates 17 includes a pair of laterally spaced first and second wing portions 21,22 extending away from the opening 19. The first wing portions 21 and the second wing portions 22 in confronting pair form together with the sidewall 18 a pair of substantially U-shaped grooves 23 opening sideways of the body 16 for receiving therein the reinforced tape edges 13, respectively. The respective front ends of the first and second wing portions 21,22 of each of the plates 17 jointly define therebetween a recess 27 beyond which the reinforced edges 13 extend through the respective grooves 23 upwardly in juxtaposed relation to each other. Each confronting pair of the wing portions 21,22 has a pair of ridges 24 disposed on the respective free ends of the wings portion 21,22 and extending longitudinally along one of the groove 23 for clamping engagement with one of the stringer tapes 12. According to a modified embodiment of the invention shown in FIGS. 5 and 6, ridges 25 of each confronting pair of wing portions 21,22 comprise a pair of teeth 26 formed complementarily in contour or aligned in meshing relation to each other. It will be understood from FIG. 6 that the toothed ridges 25 present an improved clamping engagement with the stringer tape 12 substantially over the ridges 24 of the first embodiment described above and shown in FIGS. 2 to 4.

Figure 3:
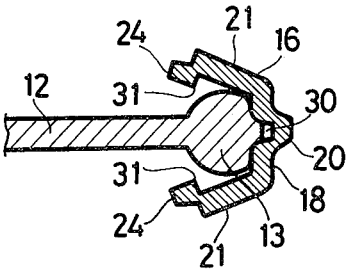
FIG. 3 is an enlarged cross-sectional view taken along line III—III of FIG. 1, showing the bridge top stop ready to be clamped to one of stringer tapes.
Figure 4:
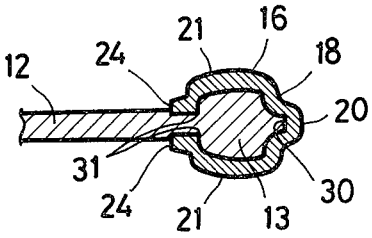
FIG. 4 is a view similar to FIG. 3, but showing the bridge top stop having been clamped to the stringer tape.
Figure 5:
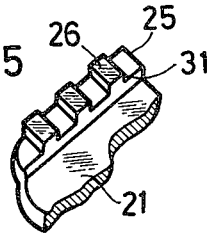
FIG. 5 is an enlarged fragmental perspective view of a modified bridge top stop according to the invention.

Application of the bridge top stop 10 to the slide fastener 11 will be discussed with reference to FIGS. 3 and 4 in which only one stringer tape 12 and one pair of wing portions 21 of the bridge top stop 10 are shown in cross section. The bridge top stop 10 is clamped by a suitable clamping device (not shown) with the reinforced tape edge 13 loosely received in the groove 23 defined by the confronting pair of wings 21 and the sidewall 18. As the wings 21 are forced to move toward each other, the reinforced edge 13 is started being deformed complementarily in contour with the groove 23. Advantageously, the recess 30 in the sidewall 18 allows the reinforced edge 13 to move into the recess 30, to thereby prevent the reinforced edge 13 from swelling or being forced out of the groove 23 before the ridges 24 of the wings 21 are brought into clamping engagement with the stringer tape 12. At the same time, the reinforced edge 13 is restricted from moving out of the groove 23 by engagement with sidewalls 31 of the respective ridges 24.

The rib 20 formed in the shape of a crescent shown in FIGS. 1 and 2 has been proven to be advantageous in strengthening or reinforcing the body 16 enough to prevent the lateral displacement of the tape holding wings 21,22 against forces applied thereto during either the clamping operation or the use of the slide fastener 11. The recess 30 in the sidewall 18 doubles as an aid in preventing the reinforced edges 13 from forced out of the grooves 23 in the bridge top stop 10 and as an aid in improving the bendability of the wings 21,22 particularly at the front end portions of the wings 21,22 which are adjacent to the mid portion of the sidewall 18, thereby when the bridge top stop 10 is clamped to the stringer tapes 12, the forces can be uniformly distributed over the entire length of the wing portions 21,22.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A bridge top stop for a slide fastener including a pair of stringer tapes each provided with a reinforced edge for carrying a row of cooperating interlocking fastener elements and a slider reciprocable along the reinforced edges for taking the fastener elements into and out of coupling engagement to open and close the slide fastener, said bridge top stop comprising:

(a) a body adapted to be clamped to the reinforced edges astride the stringer tapes;

(b) said body including a sidewall inwardly curved to define a substantially inverted U-shaped opening receptive of the front portion of the slider and a pair of plates connected at one edge by said sidewall, each of said plates including a pair of laterally spaced first and second wing portions extending away from said opening, said first wing portions and said second wing portions in confronting pair forming jointly with said sidewall a pair of grooves for receiving therein the reinforced edges, respectively;

(c) bulged rib projecting from said sidewall along said opening and extending longitudinally along said sidewall; said bulged rib defining a recess that grips said reinforced edges of the stringer tapes to secure the bridge top stop thereto, said bulged rib projecting progressively into said U-shaped opening in a direction from ends to the mid-portion of said sidewall to trace a crescent shape, and said recess having a depth progressively increasing in a direction from ends to the mid-portion of said sidewall; and (d) each confronting pair of said wing portions having ridges disposed on the respective free ends thereof and extending longitudinally along one of said grooves for clamping engagement with one of the stringer tapes.

2. A bridge top stop according to claim 1, said ridges of each confronting pair of said wing portions comprising a pair of teeth aligned in meshing relation to each other.

* * * * *